US005398998A

United States Patent [19]

Evans

[11] Patent Number: 5,398,998

[45] Date of Patent: Mar. 21, 1995

[54] PRESSURE ACTUATED FRACTURE DEVICE

[75] Inventor: Byrce B. Evans, Jackson, Mich.

[73] Assignee: Aeroquip Corporation, Maumee, Ohio

[21] Appl. No.: 192,408

[22] Filed: Feb. 4, 1994

[51] Int. Cl.[6] ..... E21C 37/04; E21C 37/10

[52] U.S. Cl. ..... 299/21; 299/23

[58] Field of Search ..... 299/20, 21, 23; 166/187

[56] References Cited

U.S. PATENT DOCUMENTS 1,630,470 5/1927 Clifford ..... 299/21
4,690,460 9/1987 Lebeder ..... 299/23 X

FOREIGN PATENT DOCUMENTS 1547766 11/1968 France ..... 299/20
93995 4/1991 Japan ..... 299/20
1180501 9/1985 U.S.S.R. ..... 299/21
8602404 4/1986 WIPO .

*Primary Examiner*—David J. Bagnell

[57] ABSTRACT

A pressure actuated fracture tool for use in splitting and fracturing hardened material, such as rock, stone, concrete and the like, having two expansible outer shells designed to move in opposition to each other along a selected axis transverse to the longitudinal axis of the tool. The outer shells define a central orifice extending longitudinally to length of the tool. An elastomeric tubular member is positioned in the central cavity between two longitudinally fixed end connectors. Upon the application of pressure to the tubular member, the outer shells expand outwardly in a determined radial diversion to contact the wall of a cavity bored in the hardened material and cause the material to cleave or split.

16 Claims, 8 Drawing Sheets

PRESSURE ACTUATED FRACTURE DEVICE

BACKGROUND OF THE INVENTION

The present invention provides a device intended for use in fracturing hardened material, such as rock, stone, concrete and the like, into small manageable units. More specifically, the present invention is intended for use in such industries as quarrying, mining, road construction and destruction and building construction and destruction. While the applications and uses of the present invention are unlimited in nature, the invention will be described herein with reference to use in the quarry and mining industry for the purpose of extracting blocks of quarry material such as granite, marble and the like. However, this description with regard to quarry and mining use are not intended to be limiting upon the scope of potential applications of the fracture device of this invention.

The estimated raw quarry production, world-wide, is approximately 40 million tons each year. The quarry material is most commonly removed from enormous quarries where large blocks of material are extracted, reduced in size, and shipped to stone cutters for further reduction in size. The most common method of extraction is provided by boring a line of holes, generally at six inch intervals, into the material formation or bedrock to create side cuts and an undercut to form a large block or cube of rock. After the holes are bored, they are most commonly filled with explosive and the explosive is detonated to cleave or split the cube along the lines formed by the bored holes. If the proper amount of explosive is used, the large block of material is successfully separated from its bed and is then shipped to the next stage of production. This use of explosives, while time honored, has proven to be quite unreliable and dangerous. Because of the difficulties in quantifying the condition of the rock below the surface, the amount of explosive necessary to cleave or separate the block of rock from its bed is most frequently based upon knowledgeable guess work. If, by chance, not enough explosives are used, the block will not separate from its bed causing need for a new round of explosives to be utilized and delaying production of the quarry in an undesirable manner. To avoid the problems resulting from a failure to remove the block from its bed, most quarryman err on the side of maximum explosive usage. As a result, the block will be separated from its bed but can, at the same time, be substantially damaged as a result of fractures and cracks created by the maximized explosion. If the block of stone is excessively cracked and fractured, it will in most cases, fail upon reduction to smaller units, thereby resulting in excessive scrap. Scrap production for certain types of materials being quarried can range as high as 80% to 90% of the material removed from the quarry, obviously an undesirable and costly outcome.

Alternative methods of quarry production include the use of wedges which are manually or mechanically driven into the drilled holes to apply pressure to the bedrock along the lines formed by the drilled holes. This has proven to be an effective but time consuming and costly method of quarry production resulting in the general acceptance by the industry of the use of explosives, even allowing for the resulting inconsistencies and wasteful amounts of scrap. However, recent worldwide preoccupation dealing with increased control over explosive materials and growing concern over the environmental hazards created by the use of explosive materials has forced the quarry industry to seek safer means to separate or cleave rock in its quarries. Further, such environmental concerns are underscored when viewed in the mining industry. If explosives must be utilized in enclosed areas, maintenance of the structural integrity of the mines is of a major concern, as well as the potential for unwanted conflagration within the mine as a result of the use of explosives. Thus, there is tremendous continued interest in developing safe and environmentally benign methods of quarry and mining production.

One solution to the dilemma has been proposed by Clifford (U.S. Pat. No. 1,630,470), providing a hydraulic cartridge composed of a flexible envelope confined at its opposed ends in a manner designed to resist longitudinal expansion. As the hydraulic pressure within the envelope is increased, the envelope is free to expand laterally or transversely within the bore hole to exert pressure therein. The cartridge taught by the Clifford reference never provided a satisfactory answer for the problems facing the quarry industry. There was a large degree of in exactitude about the ability of the cartridge to properly expand in the appropriate direction without failure. The elastomeric outer shell or expansible outer shell of Clifford was most commonly prone to rupture resulting in loss of hydraulic pressure during use. As a result, the apparatus disclosed and taught by Clifford in 1927 never became a commercially viable product for reliably fracturing and splitting stone in quarry operations. Quarry operators continue to search for alternative methods of stone splitting and stone breaking.

More recently, an international publication from the World Intellectual Property Organization, WO86-02404, by Derman, takes the disclosures of the prior Clifford reference and attempts to overcome the deficiencies of Clifford. Derman provides a fracturing member having displacable walls formed from elastomeric material, for example a thick walled rubber hose which is displacable in a direction transverse to the axis of the bore. The displaceable walls are connected with a device for preventing uncontrolled expansion in the longitudinal direction. The Derman reference attacks the problem of the elastomeric material having a tendency to creep through the clearance space located between the members of the fracturing unit and the surrounding wall of the bore. Derman presents a variety of combinations and end member features for solving the creeping problem of the elastomeric wall. Most of the end members of Derman are expansible in a direction toward the walls and culminate with a greater diameter than the elastomeric wall to prevent longitudinal creeping of the elastomeric material as the material is expanded against the wall of the bore. Derman further discloses a fracturing member having a metallic body with a longitudinal opening which contains an expansible rubber element. Rigid piston members are positioned in the longitudinal Opening and as fluid pressure is applied to the rubber element and the rubber expands, the pistons are displaced in a transverse direction. The pistons are described as being composed of a relatively rigid material, for example, nylon, while the walls of the body element are composed of metal. While the Derman reference provides substantially improved teachings over the Clifford reference, the embodiments taught by Derman have not proven effective in a commercial sense. The preferred structure of Derman, having an expansible outer layer with expansible end caps to eliminate longitudinal expansion of the expansible material between the fracture member and the wall of the bore, does not overcome the inherent deficiencies of having an expansible elastomeric member which comes into contact with the bore of the quarry material. The alternative embodiment of Derman, which provides for a hardened elastomeric piston member to transversely expand against the wall of the bore is known to be prone to failure due to sharp edges and corners around which the elastomeric material within the hardened fracture member must expand. Further problems have been encountered as a result of the tubular elastomeric member failing to provide sufficient force in the desired transverse direction.

Therefore, a need remains for a highly reliable device for use in quarry and mining operations which is environmentally safe and improves upon the reliability of prior art devices, thereby eliminating the need for use of explosives and other highly unpredictable and unreliable methods of quarrying. This objective is met by the present invention.

Further, a need remains for a highly reliable device for use in fracturing hardened material into small manageable units which is environmentally safe and improves upon the reliability of prior art devices. This objective is met by the present invention.

SUMMARY OF THE INVENTION

The present invention provides a device that, when installed into a hole bored into hardened material, such as rock, stone, concrete and the like, provides a maximum separating force which is directional in nature, and transverse to the longitidual axis of the bore hole. The present invention achieves the objective by providing a hydraulic fracturing device, which applies a force in opposite directions along a line transverse to the longitidual axis of the hole into which it is inserted. The fracture device of the present invention includes two expansible longitudinally extending shells which, taken together, provide an exterior surface that is tubular in shape and enclose a longitudinally extending orifice which contains an expansible elastomeric member. The tubular two-piece metal shell is supported by end connectors which are longitudinally anchored together to prevent unwanted longitudinal expansion of the fracture device upon pressurization of the expansible member. Upon the application of hydraulic pressure to the expansible member, the member expands in a direction transverse to the longitudinal axis causing the two shells to move relative to one another in opposed transverse directions along one axis. The elastomeric member and metal shells are designed to provide force in a transverse axial direction which is multiple times greater than any forces applied along the undirected or unspecified axis. For instance, if the longitudinal axis of the fracture member is categorized as the Z axis and the X axis and Y axis are transverse to the Z axis, the present invention provides a multiple of force substantially greater along the X axis when compared with the Y axis and no forces are applied along the Z axis. Thus, the present invention provides a substantial improvement upon the efforts of those in the past as taught by the prior art.

The present invention will be more readily understood with reference to the accompanying drawings and the following description of the preferred embodiments.

DETAILED DESCRIPTION OF THE PREFERRED EMBODIMENTS

Figure 1:
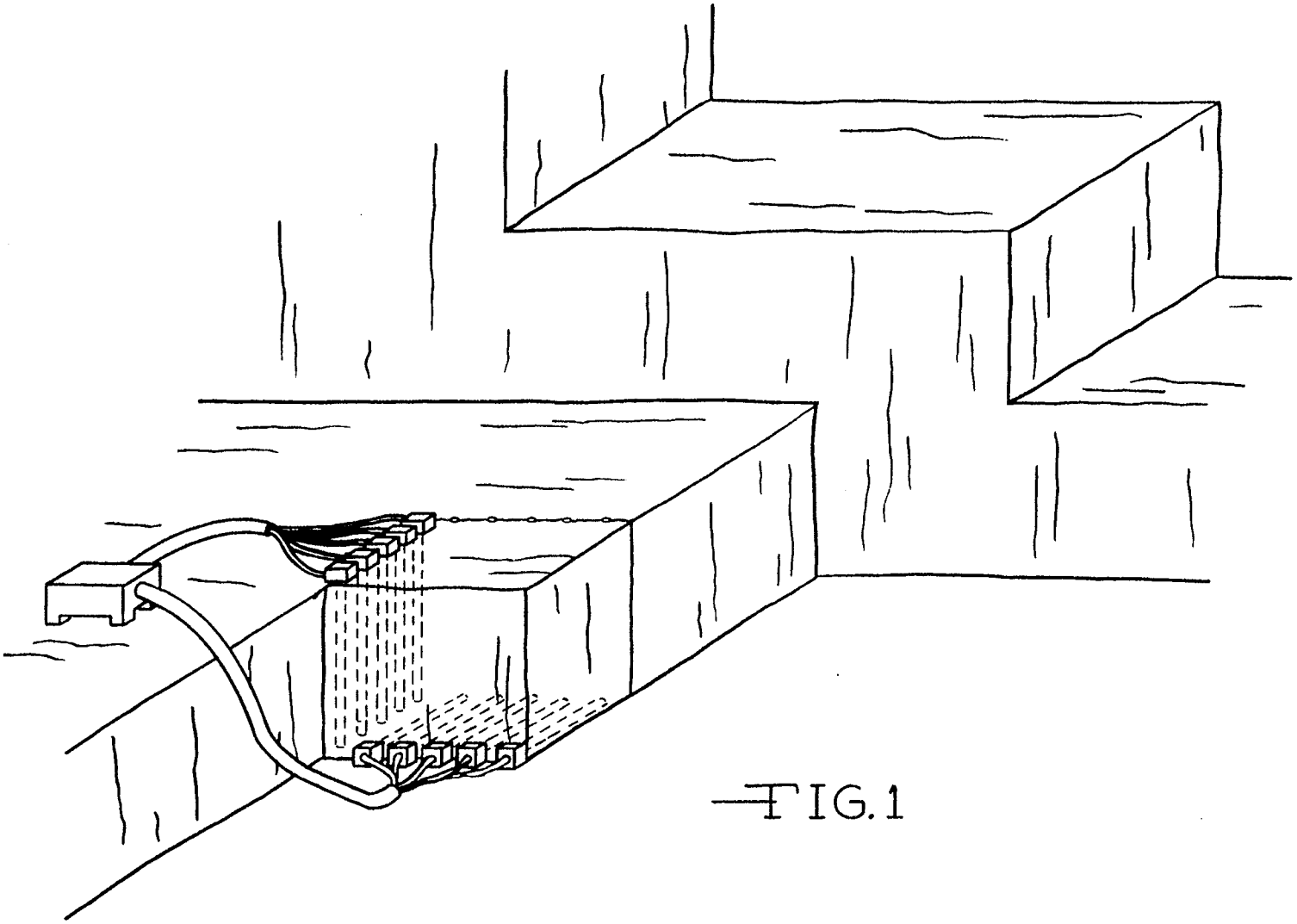
FIG. 1 is a diagrammatic illustration of a quarry operation showing the present invention in use.
Figure 2:
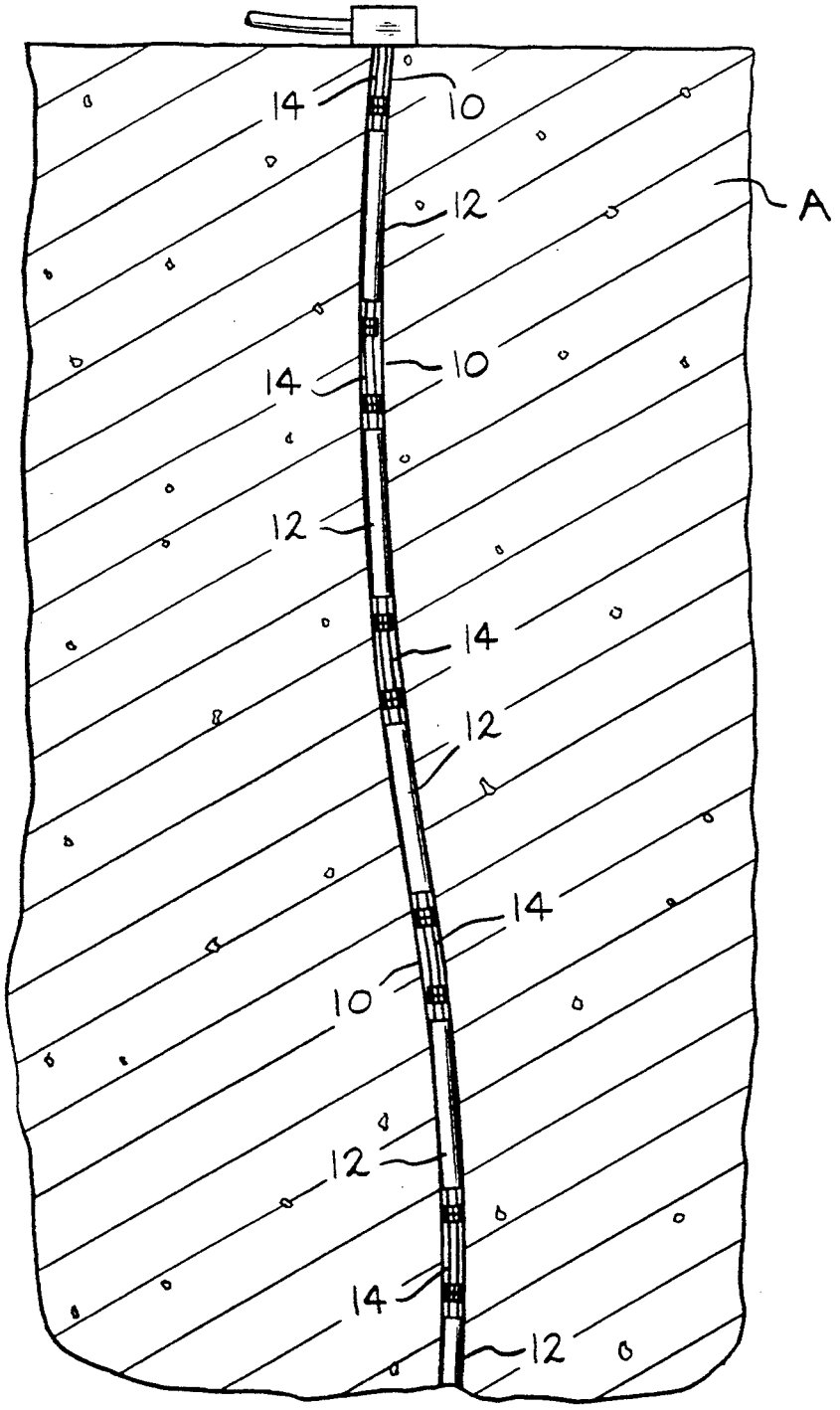
FIG. 2 is a diagrammatic illustration of a hole bored in hardened material with a plurality of devices of the present invention placed in series within the bore.

The present invention relates to a pressure actuated tool intended for use in fracturing hardened material, such as rock, stone, concrete and the like, into small manageable units. The fracture device is intended for use in such industries as quarrying, mining, road construction and destruction and building construction and destruction. It meets the objective of providing an environmentally safe and reliable tool for removing designated segments of hardened material, such as granite, marble, concrete and the like. As shown diagrammatically in FIGS. 1 and 2, the fracture device of this invention is shown in an embodiment structured for installation in longitudinal holes which are bored or drilled into the hardened material, such as the bedrock found in a quarry. The holes are bored along a given line of desired separation and are spaced apart such that, upon application of appropriate pressure to the fracture device of this invention, the tool will provide a force which is directional in nature, transverse to the longitudinal axis of the hole, causing the material to separate or fracture along the line created by the bored holes. Referring now to FIG. 2, the hole 10 that is bored into the material A extends longitudinally into the material for a specified distance. The hole 10, as bored, very seldom ends up as a direct straight line through the material A. Rather, as illustrated in FIG. 2, the hole commonly develops a curvature that is usually unpredictable. For instance, if the hole is bored through the bedrock of a quarry, the curvature of the hole 10 is produced by the drill (not shown) seeking the path of least resistance as it proceeds downward through the quarry material. If there are internal fractures, soft spots, or other areas of less dense or softer quarry material, the drill will naturally tend to wander into those weaker and less resistant portions of the bedrock. Thus, most commonly, the hole 10 will end up having a curvature as depicted in FIG. 2. To accommodate the curvature of the hole 10, in particular since the curvature is difficult to sense from above ground, the fracture tools 12 of the present invention are provided in specified lengths (i.e. 6 inches, 12 inches, 18 inches, 24 inches). The tools 12 are interconnected by smaller diameter tubing 14, preferably flexible in nature and longitudinally rigid, capable of withstanding the high pressures used in the quarry operations. The interconnected lengths of the tool 12 and tubing 14 are then connected into the hole 10 and will provide selective transverse forces within the hole 10 for the full length of the hole 10. Preferably, the pressurization of the tool is hydraulic in nature, however, other forms of pressurization may be utilized if desired.

Figure 3:
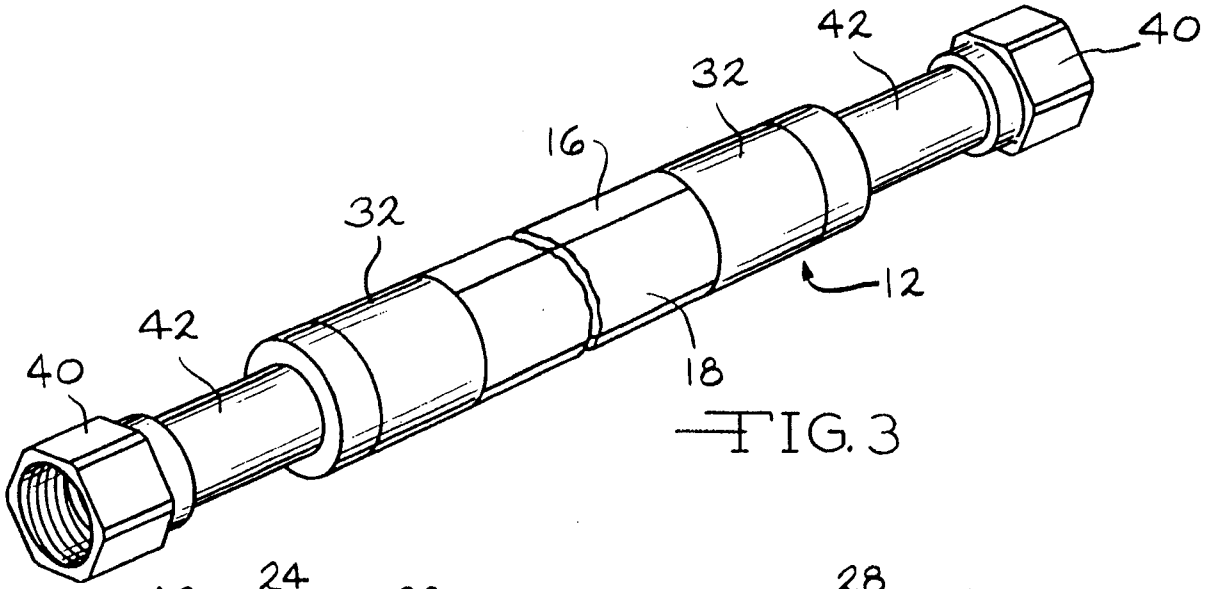
FIG. 3 is a perspective view of a first embodiment of the pressure actuated fracture device of the present invention.
Figure 4:
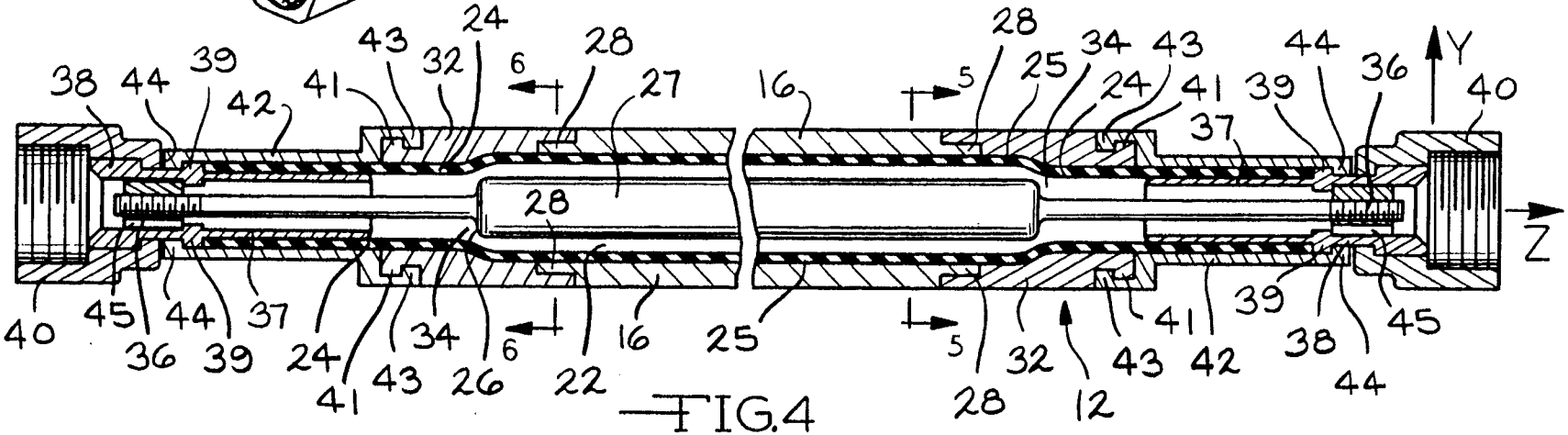
FIG. 4 is a sectional view of the fracture device of FIG. 3.
Figure 5:
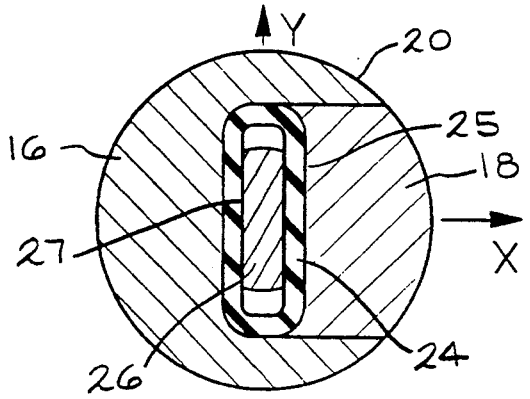
FIG. 5 is a sectional view taken along line 5—5 of FIG. 4.

Referring now to FIGS. 3–8, a first embodiment of the fracture tool 12 of the present invention is shown. The fracture tool 12 includes a C-shaped expansion member 16, preferably constructed of hardened steel and an insert expansion member 18, also constructed of hardened steel and designed to mate with the C-shaped expansion member 16 to form an elongated tubular member having an annular or concentric outer surface as shown in FIG. 5. The C-shaped expansion member 16 and the insert expansion member 18 are configured to provide a longitudinally extending rectangularly shaped oval aperture 22. The aperture 22 extends the full length of the C-shaped expansion member 16 and insert expansion member 18. Positioned in the aperture or central cavity 22 is an elastomeric tube 24 adapted to engage with the inside perimeter of the oval aperture 22. The elastomeric tube 24 is preferably composed of a rubber or thermoplastic compound which has excellent tear and bridge strength. In the preferred embodiment, the rectangular oval-like shape of the elastomeric tube 24 extends the full length of the C-shaped member 16, and insert member 18 after which the tube changes its cross-sectional shape to a circular or tubular member. A longitudinal tie bar 26, which extends the full length of the tool 12, is positioned inside the tube 24 along the longitudinal axis of the tool. In the area encompassed by the C-shaped member 16 and insert member 18, the tie bar 26 is flattened 27 to fit within the rectangular oval-like central cavity 22 of the elastomeric tube 24. The tie bar 26 and tube 24 transition to a round cross-section in the position of each that extends beyond the opposed ends of the C-shaped member 16 and insert member 18.

Figure 6:
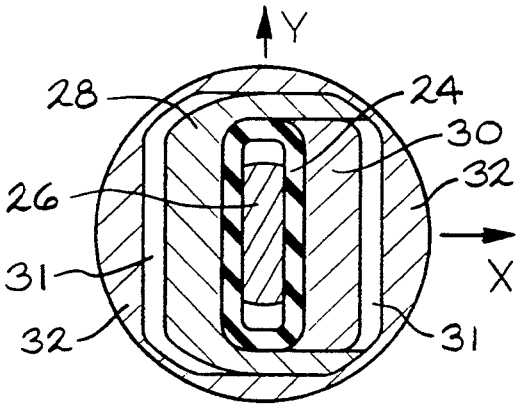
FIG. 6 is a sectional view taken along line 6—6 of FIG. 4.
Figure 7:
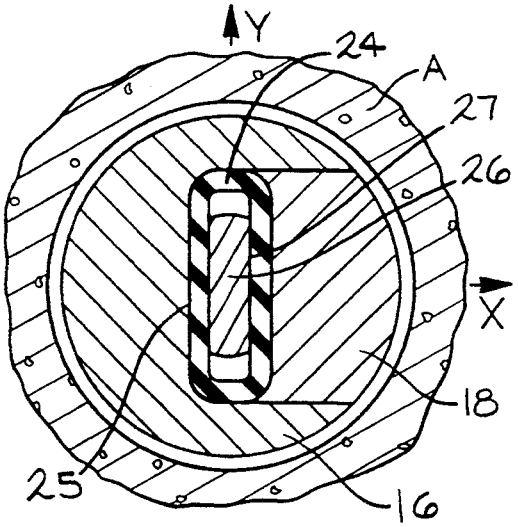
FIG. 7 is the sectional view of FIG. 5 placed within a bored hole of material.
Figure 8:
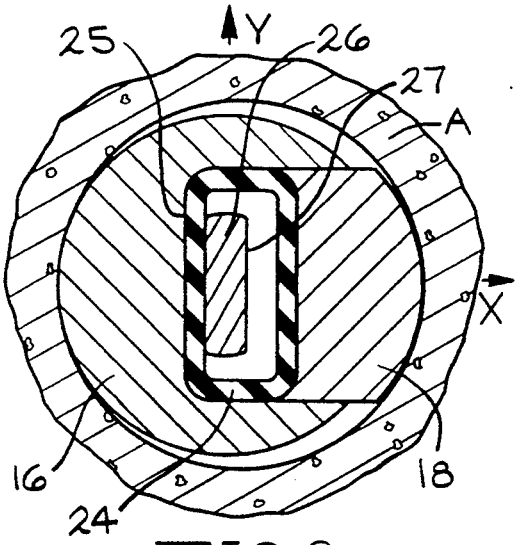
FIG. 8 is the sectional view of FIG. 5 placed within the bored hole of material showing the fracture device in an expanded mode.
Figure 9:
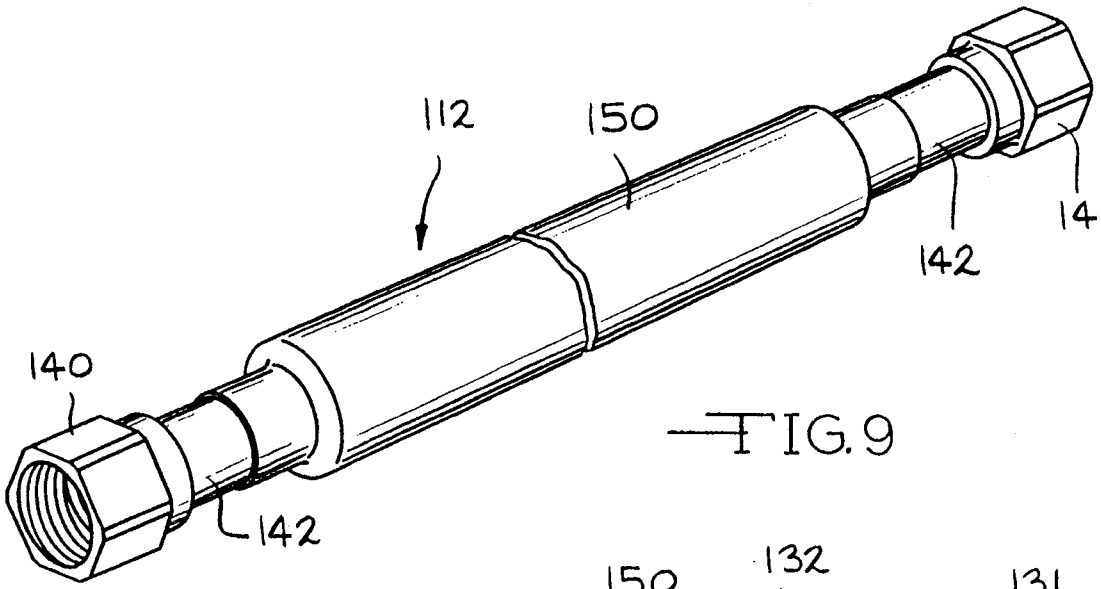
FIG. 9 is a perspective view of a second embodiment of the fracture device of the present invention.

Referring to FIGS. 6 and 4, the C-shaped expansion member 16 includes longitudinally extending tangs 28 which are positioned to extend from each end of the member 16. The insert expansion member 18 further includes longitudinally extending tangs 30 which are also positioned to extend from the opposed ends of the insert expansion member 18. A transition member 32 is positioned to abut the C-shaped member 16 and insert member 18 and enclose the tangs 28, 30, at each opposed end, thereby capturing the C-shaped member 16 and insert member 18 in position together. As can best be seen in FIG. 6, the transition members 32 each include an aperture 31 which is approximately sized in relation to the tangs 28, 30, such that the tangs 28, 30 are allowed an increment of movement transverse to the longitudinal axis of the tool 12. Each transition member 32 includes a longitudinally extending transition cavity 34 which transitions from a cross-sectional shape commensurate with the rectangular oval-like central cavity 22 formed by the C-shaped member 16 and insert member 18 to that of a circular cross-section at its opposed ends. Concurrently, the tie bar 26 transitions from its flat portion 27 to a circular cross-section within the transition cavity 34 and the elastomeric tube 24 transitions from its flat shape 25 to a circular cross-section within the transition cavity 34.

The extreme opposed ends 36 of the tie bar 26 are each threaded to receive a threaded nipple member 38 and a connector nut 40. The nipple member 38 includes a radially outwardly extending lip 39 which abuts the end of the elastomeric tube 24 as the tube is extended over a hollow sleeve 37 portion of the nipple member 38. The transition member 32 further includes a radially outwardly extending lip 41 which is located at the distal end positioned away from the C-shaped member 16 and insert member 18. A crimp member 42 is positioned about the circular portion of the elastomeric tube 24 and includes inwardly radially extending lips 43, 44, which encircle and engage the transition lip 41 and nipple lip 39 respectively. As the crimp member 42 is crimped or squeezed into a fixed permanent position, it effectively seals the transition member 32 with the elastomeric tube 24 against the hollow sleeve 37 to provide an air tight and leak proof pressure chamber extending between opposed connector nuts 40. The nipple member 38, in the area where it receives the threaded end 36 of the tie rod 26, is, preferably, of a cross-sectional shape which provides channels 45, thereby allowing pressurizing fluid to flow through the connector nut 40 at one end of the tool 12 through the hollow sleeve 37, into the transition cavity 34 and the central cavity aperture 22 and out through the similar components at the opposed end of the tool 12. Since the tie bar 26 is threaded into the opposed nipple members 38, the strength of the tie bar prevents the tool 12 from experiencing longitudinal expansion upon the application and buildup of pressure within the elastomeric tube 24. Therefore, as the pressure is increased within the tube 24, forces will be developed which are directed to act against the only potential moveable parts, the C-shaped expansion member 16 and insert expansion member 18.

Viewing the elastomeric tube 24 in its rectangular oval-shape, it can be seen that the longitudinal axis is identifiable as a Z axis and that the transverse directions can be identified in terms of an X axis and a Y axis. The transverse axis or X axis in which the slide member 16 and insert member 18 engage the long side of the rectangular oval-shaped tube 24, thereby provides contact with five times the surface area of the elastomeric tube 24 than that available in the Y axis. Thus, as the pressure increases within the elastomeric tube 24, it will exert five times greater pressure along the X axis than in the Y axis direction. Viewing FIGS. 7 and 8, it can be seen that the fracture tool 12 fits within the material A with close tolerances and as the elastomeric tube 24 is pressured, the pressure will cause the C-shaped expansion member 16 and insert expansion member 18 to move relative to each other along the X axis in a direction transverse to the longitudinal axis of the tool 12 until the C-shaped member 16 and insert member 18 engage the material A. Once the C-shaped member 16 and insert member 18 are engaged with the wall of the material A, the pressure within the tube 24 continues to increase, eventually causing the material A to fracture and separate.

Generally, it is known that separation of quarry material and rock can be provided at an explosive application of up to 10,000 psi. The tools 12 are interconnected, to enable access to the curved full length of the bored hole as shown in FIG. 2, by longitudinally rigid connectors 24, which are threaded into the connector nuts 40. This provides for a plurality of tools 12 to be used in series without suffering failure as a result of expansion in the longitudinal direction under the high pressure end loads. The tie bars 26 are designed to withstand an end load in excess of 10,000 psi, thus preventing unwanted longitudinal expansion of the tools. Further, in many instances, it is preferable that the embodiment of the fracture tool 12 be enclosed in a thin tubular dirt sleeve (not shown) formed from teflon or polypropylene (not shown) which is of a thickness designed only to withstand the fouling of the tool 12 by dirt, dust and stone chips.

Figure 10:
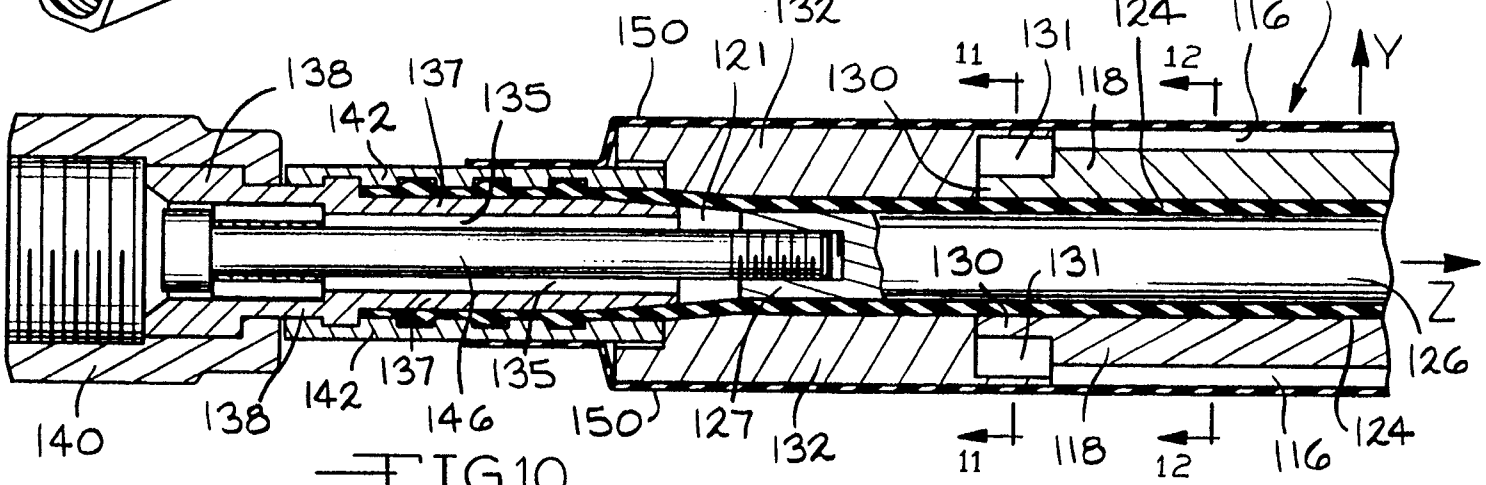
FIG. 10 is a partial sectional view of one end of the fracture device of FIG. 9.
Figure 11:
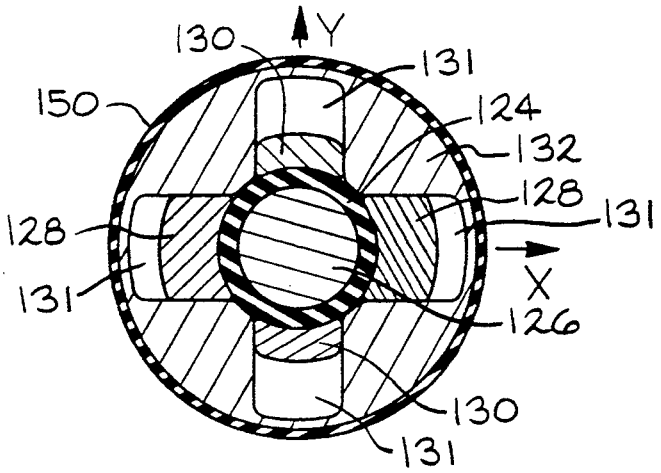
FIG. 11 is a sectional view taken along line 11—11 of FIG. 10.
Figure 12:
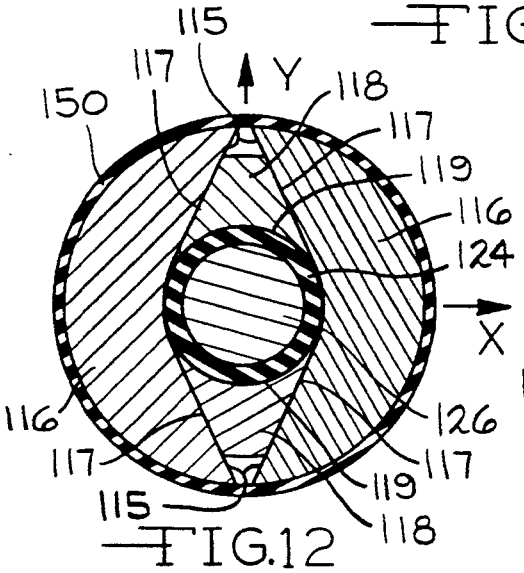
FIG. 12 is a sectional view taken along line 12—12 of FIG. 10.

Referring now to FIGS. 9–14, an alternative preferred embodiment of the fracture tool of the present invention is shown. Referring to FIGS. 10 and 12, the tool 112 includes a pair of clam shell shaped members 116 positioned in opposition along a longitudinal axis to form a generally annular or concentric shaped outer surface. As shown in FIG. 12 and FIG. 10, the clam shell shaped members 116 are separated by opposed wedge members 118. Each wedge member 112 includes a wedge shaped surface 117 designed to engage with and slide along the interior opposed surfaces 115 of the clam shell shaped members 116. The interior surfaces 115 defined by the clam shell shaped members 116 and the interior surfaces 119 of the wedge members 118, taken together with all of the members in proper position, define a generally circular longitudinally extending cavity 121 spaced about the axial centerline of the tool 112. As further shown in FIGS. 10, 11 and 14, the clam shell shaped members 116 and wedge members 118 include tangs 128 and 130, respectively. As with the first embodiment discussed, the tool 112 includes a pair of transition members 32, each of which are positioned at the opposed ends of the clam shell member 116 and include apertures or slots 131 designed to receive the tangs 128, 130, thereby capturing the clam shell shaped members 116 and wedge members 118 in position. The slots 131 in the transition members 132 are expansively larger than the tangs 128, 130 to allow movement of the clam shell shaped members 116 and the wedge members 118 with respect to each other. An elastomeric tube 124, positioned to engage the interior surfaces 115, 119 of the clam shell shaped members 116 and wedge members 118 respectively, extends the length of the cavity 121. An annular longitudinally extending tie bar 126 is positioned within the elastomeric tube 124 and includes a female threaded end portion 127 located at each opposed end of the tie bar 126. The opposed ends of the tool 112 include connector nuts 140, which enclose nipple members 138 having a hollow sleeve 137 which extends toward and mates with the transition members 132 in the final assembled product. The elastomeric tube 124 extends around the hollow sleeve member 137. A crimp member 142 is positioned in tight fashion about the nipple member 138, hollow sleeve member 137, and elastomeric tube 124 to create a sealed and fluid tight engagement between the tube 124 and connector nuts 140. Finally, positioned within the nipple member 138 is a screw member 146, which extends from engagement with the connector nuts 140 through the interior cavity 135 of the hollow sleeve member 137 to engage the female threaded end 127 of the tie bar 126. Tightening of the threaded screw 146 completes the interconnection and strengthens the engagement between the connector nut 140 and crimp member 142 assembly with the transition member 132 and clam shell shaped members 116 and wedge members 118. Thus, the tool 112 as shown in FIGS. 9–14 is sealed against leakage under pressure and is capable of withstanding strong end forces which are produced along the longitudinal axis in the same manner as the previously-described embodiment, through the use of the interconnected tie bars.

Figure 13:
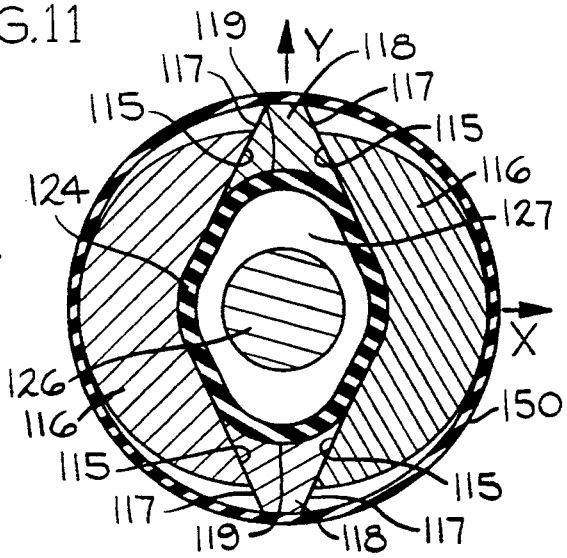
FIG. 13 is the sectional view of FIG. 12 showing the fracture device in an expanded mode.
Figure 14:
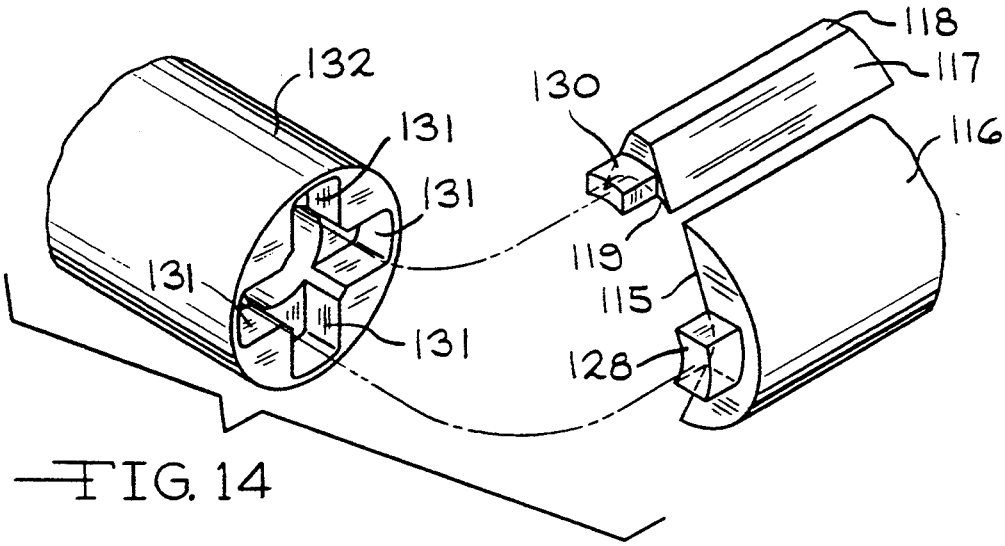
FIG. 14 is a diagrammatic view showing the relative juxtaposition of a wedge member, a clam shell member and a transition member of the fracture device of FIG. 9.

In operation, the tool 112 of FIGS. 9–14 provides a mechanical advantage in that it directs all pressurization forces to action in a single direction. For example, if the longitudinal axis is labeled as the Z axis and the transverse axes are the X axis and the Y axis as shown in FIGS. 11–13, the following movement along the axes occurs as the result of pressurizing the elastomeric tube 124. By pressurizing the elastomeric tube 124 as shown in FIG. 13, the wedge members 118 are driven in the Y direction. However, the interface between the surfaces 117 of the wedge members 118 and the surfaces 115 of the clam shell shaped members 116 provides that the forces driving the wedge members 118 in the Y direction are transferred to motion along the X axis against the clam shell shaped members 116 to drive the clam shell members 116 in the X direction. Further, the elastomeric tube 124 expands to provide continuous pressure in the longitudinal cavity 121 against the interior surface 119 of the wedge members 118 and the interior surface 115 of the clam shell shaped members 116 to further add force along the X axis to move the clam shell shaped members 116. As result of the transference of forces through the wedge shaped members 118 and the application of forces through the tube 124, it has been calculated that the forces applied along the X axis are increased from 25% to 71% over the previously-discussed embodiment as shown in FIG. 3. Thus, the tool 112 of FIGS. 9–14 provides a highly efficient mechanical advantage over the previously discussed embodiments.

Finally, to prevent unwanted contamination of the working parts of the tool by dirt, dust, chips and the like, a thin tubular dirt sleeve 150, formed from teflon or polypropylene is provided to extend, preferably, between crimp members 142.

Figure 15:
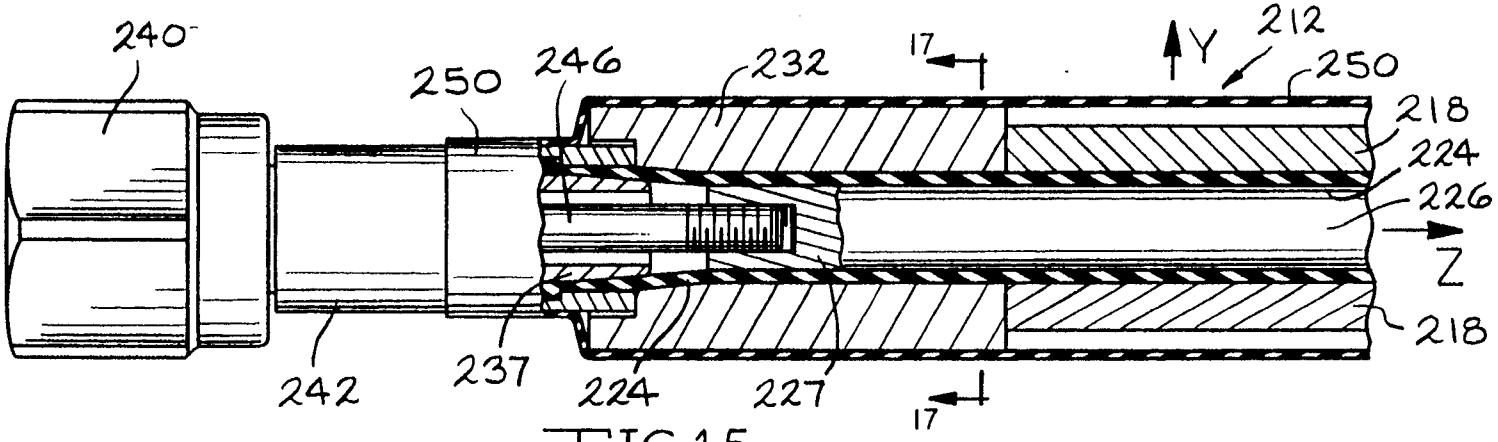
FIG. 15 is a partial cutaway view showing a structural alternative embodiment of the device of FIG. 9.
Figure 16:
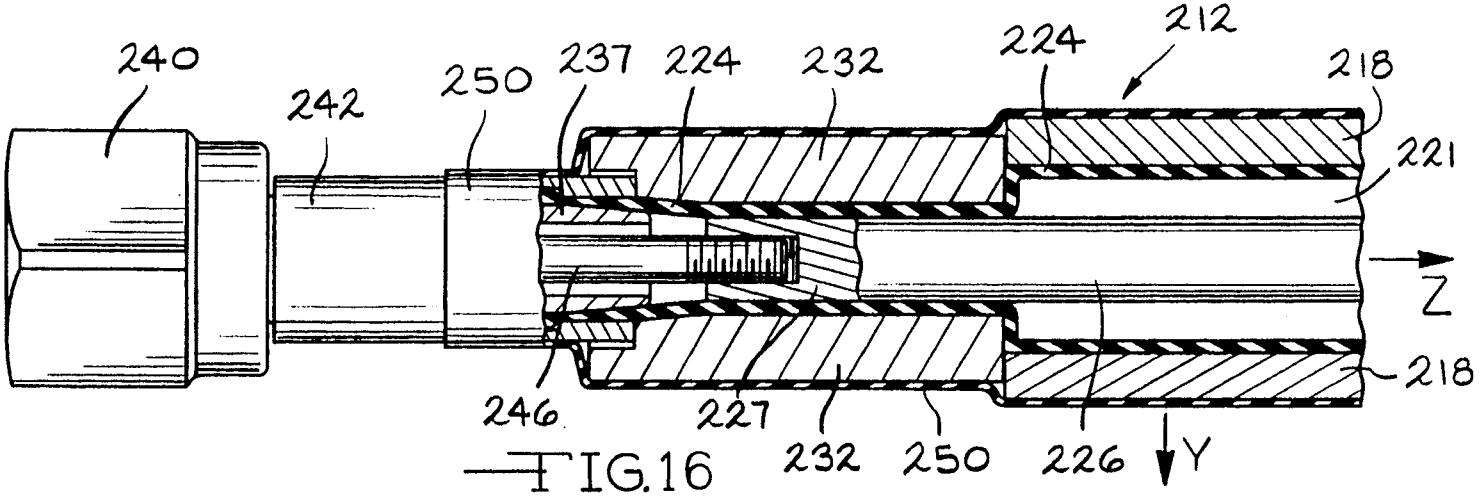
FIG. 16 is a partial cutaway view of the device of FIG. 15 showing the fracture device in an expanded mode.
Figure 17:
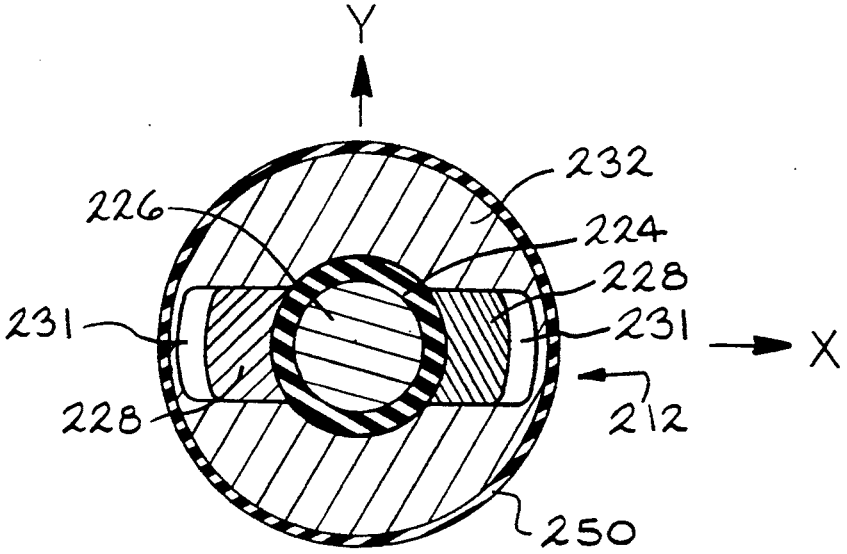
FIG. 17 is a sectional view taken along line 17 of FIG. 15.

Referring now to FIGS. 15–17, an alternative embodiment of the fracture tool 212 is shown, which is a minor variation of the fracture tool of FIG. 9–14. The basic components of the tool of FIGS. 15–17 remain the same. A pair of clam shell shaped members 216 separated by wedge shaped members 218 are positioned together to form an angular concentric outer surface. The wedge shaped members 218 have a wedge shaped surface which engages the interior surface of the clam shell shaped members 216. The clam shell shaped members 216 include tangs 228 which are received in slots 231 found in a transition member 232. The wedge shaped members 218 do not have tangs in this embodiment, providing the distinction of this embodiment over the previously-described embodiment of FIGS. 9–14. The wedge shaped members 218 butt against the transition member 232. The longitudinally extending cavity 221 formed by the clam shell shaped members 216 and wedge members 218 is again lined with an elastomeric tube 224 which extends the entire length of cavity 221. A tie bar 226 is positioned inside the elastomeric tube 224 and includes opposed female threaded ends 227. A threaded screw 246, which is positioned within a hollow sleeve 237 extending from a nipple (not shown) is engaged with an end connector nut 240 and is used to lock the tie bar 226 in position and prevent any longitudinal movement of components of the tool 212, as the result of end pressure forces. A crimp member 242 extends between the connector nut 240 and the transition member 232 to tightly engage the tube 224 with the hollow sleeve 237, thereby ensuring that the tube 224 and tool 212 remain sealed and leakproof under pressure. A dirt sleeve 250 encloses all the working components of the tool 212 and extends between opposed crimp members 242.

In operation, the tool 212 of FIGS. 15–17 operates in the same manner as the embodiment discussed with regard to FIGS. 9–14. As pressure 212 is applied through the elastomeric tube 224, the tube 224 expands thereby driving the wedge members 218 outwardly along the Y axis. The interface between the wedge shape surface of the wedge members 218 and the clam shell shaped members 216 causes the clam shell shaped members 218 to drive in the transverse direction along the X axis. The forces applied by the elastomeric tube 224 against the inner surface of the clam shell shaped members 216 further applies forces along the X axis. Thus, all forces applied by the elastomeric tube 224 are applied in the singular X direction transverse to the longitudinal axis of the hydraulic tool 212.

The description of the above embodiments is intended to be illustrative in nature and is not intended to be fully limiting upon the scope and content of the following claims.

I claim:

1. A pressure actuated tool for use in fracturing a large hardened mass of material into smaller units of desired size and shape, the tool being positioned in longitudinally oriented cavities bored into the hardened material, wherein the structure of the tool comprises, in combination:

a first longitudinally extending expansion member, having a specified length and a first end and an opposed end, and a second longitudinally extending expansion member, having a similar specified length and a first end and an opposed second end, juxtaposed with said first expansion member, said juxtaposed first and second expansion members defining a generally concentric outer surface and a central cavity extending longitudinally about the axial centerline defined by said juxtaposed expansion members;

a first transition member engaged with the first ends of said expansion members and a second transition member engaged with the opposed ends of said expansion members to retain said expansion members in such relative juxtaposition and allow movement by said expansion members only in a predetermined direction transverse to such axial centerline, said transition members each defining a transition cavity extending longitudinally through said transition member about said axial centerline and in communication with said central cavity;

an elastomeric tubular member positioned within said central cavity and said transition cavities;

a tie bar extending along such axial centerline and positioned within said elastomeric tubular member;

a first connector member defining a centerline cavity positioned adjacent said first transition member and second connector member defining a centerline cavity positioned adjacent said second transition member;

means for engaging each of said connector members with its respective transition member, capturing said tubular member, capturing said tubular member in leak-proof and airtight communication with said centerline cavities of said connector members and fixing said connector members with the opposed ends of said tie bar to prevent any longitudinal movement of such components when pressure is applied to said tubular member; and, whereby said tubular member expands under such pressure forcing said expansion members to move radially outward in predetermined and opposed transverse directions to engage the wall of such longitudinally oriented cavity and apply pressure thereto.

2. The tool of claim 1, further including an interconnector member, defining a longitudinally extending cavity and being longitudinally rigid, said interconnector member having a first end designed to mate with a connector member of a first tool and an opposed end designed to mate with a connector member of a second tool, thereby interconnecting such first and second tools in series with a longitudinal cavity extending therethrough, wherein a specified plurality of interconnector members are positioned to interconnect a specified plurality of tools for positioning within the full length of such longitudinally oriented cavity in such hardened material.

3. The tool of claim 1, wherein all said components of said tool are capable of generating forces equivalent to 10,000 psi explosives.

4. The tool of claim 1, wherein each of said expansion members includes a tang member extending longitudinally away from each end of each expansion member and said transition members each include an orifice for receiving said tang members of said expansion members, wherein each of said orifice is sized larger than its respective tang member to provide room for said tang member to move in such predetermined and opposed directions, transverse to such longitudinal axis.

5. The tool of claim 1, wherein said central cavity defined by said expansion members is of a generally rectangular oval-shape, wherein the long sides of such rectangular shape are oriented perpendicular to such predetermined direction of travel of said expansion members, and said tubular member and said tie bar are correspondingly of a generally rectangular oval-shape designed to mate with said central cavity.

6. The tool of claim 5, wherein said transition cavity of each transition member gradually changes shape from a generally rectangular oval-shape proximate the joinder of the transition member with the expansion members to a generally concentric shape at the end opposed to said expansion members.

7. The tool of claim 6, wherein each opposed end of said tubular member and said tie bar also correspondingly change in cross-sectional shape from such rectangular oval shape to such concentric shape to mate with said transition cavity.

8. The tool of claim 1, further including a hollow sleeve member engaged with each of said connector members, wherein said tubular member extends beyond each of said transition members and said hollow sleeve member fits within said tubular member and mates therewith, and a crimp member positioned between each of said connector members around said tubular member to seal said tubular member against said hollow sleeve in a leak-proof airtight member.

9. The tool of claim 8, further including a flexible dirt sleeve encompassing said expansion members, said transition members and part of each crimp member.

10. The tool of claim 1, wherein said expansion members comprise opposed clam-shell shaped members, each clam-shell shaped member having a generally curved outer surface and an angularly disposed interior surface, and further including two wedge shaped members positioned between said clam-shell shaped members, said wedge-shaped members having wedge surfaces designed to mate with said angular interior surfaces of said clam-shell shaped members and a curved interior surface, wherein said curved interior surface and a portion of said angular interior surfaces not engaged with said wedge member act together to form a central cavity of a generally concentric cross-section, whereby expansion of said tubular member under pressure forces said clam-shell shaped members outward in such predetermined and opposed transverse direction and forces said wedge member radially outward, wherein such interface between said wedge surfaces and said angular interior surfaces further causes the application of force to said clam-shell shaped members from the movement of said wedge members to move said clam-shell shaped members.

11. The tool of claim 10, further including an interconnector member defining a longitudinally extending cavity and being longitudinally rigid, said interconnector member having a first end designed to mate with a connector member of a first tool and an opposed end designed to mate with a connector member of a second tool, thereby interconnecting such first and second tools in series with a longitudinal cavity extending therethrough, wherein a specified plurality of interconnector members are positioned to interconnect a specified plurality of tools for positioning within the full length of such longitudinally oriented cavity in such hardened material.

12. The tool of claim 10, wherein all said components of said tool are capable of generating forces ranging equivalent to 10,000 psi explosives.

13. The tool of claim 10, wherein each of said clam-shell members includes a tang member extending longitudinally away from each end of each clam-shell member and said transition members each include an orifice for receiving said tang members of said clam-shell members, wherein each of said orifices is sized larger than its respective tang member to provide room for said tang member to move in such predetermined and opposed directions, transverse to such longitudinal axis.

14. The tool of claim 10, wherein each of said clam-shell members and said wedge members include a tang member extending longitudinally away from each end of said clam-shell members and said wedge members and said transition members each include a plurality of orifices, each orifice for receiving one of said tang members, wherein each of said orifices is sized larger than its respective tang member to provide room for said tang member to move in such predetermined and opposed directions, transverse to each longitudinal axis.

15. The tool of claim 10, further including a hollow sleeve member engaged with each of said connector members, wherein said tubular member extends beyond each of said transition members and said hollow sleeve member fits within said tubular member and mates therewith, and a crimp member positioned between each of said connector members around said tubular member to seal said tubular member against said hollow sleeve in a leak-proof airtight member.

16. The tool of claim 10, further including a flexible dirt sleeve encompassing said expansion members, said transition members, and part of each crimp member.

* * * * *